US009728894B2

(12) United States Patent
Miyazaki et al.

(10) Patent No.: US 9,728,894 B2
(45) Date of Patent: Aug. 8, 2017

(54) DEVICE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Katsushi Miyazaki, Mie (JP); Hiroyoshi Maesoba, Mie (JP); Ryoya Okamoto, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMIOTO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 14/781,049

(22) PCT Filed: Mar. 20, 2014

(86) PCT No.: PCT/JP2014/057732

§ 371 (c)(1),
(2) Date: Sep. 29, 2015

(87) PCT Pub. No.: WO2014/162888

PCT Pub. Date: Oct. 9, 2014

(65) Prior Publication Data

US 2016/0056576 A1 Feb. 25, 2016

(30) Foreign Application Priority Data

Apr. 5, 2013 (JP) ..... 2013-079436

(51) Int. Cl.

| | |
|---|---|
| ***H01R 4/60*** | (2006.01) |
| ***H01R 13/631*** | (2006.01) |
| ***H01R 13/514*** | (2006.01) |

(52) U.S. Cl.
CPC ..... *H01R 13/6315* (2013.01); *H01R 13/514* (2013.01)

(58) Field of Classification Search
CPC ..... H01R 25/006; H01R 25/164; H02G 3/00; Y02E 60/12; H01M 2/206
(Continued)

(56) References Cited

U.S. PATENT DOCUMENTS 5,203,713 A * 4/1993 French ..... H02G 3/288 439/211
5,431,586 A 7/1995 Klas
(Continued)

FOREIGN PATENT DOCUMENTS

DE 29812500 U1 9/1998
DE 202012103360 U1 1/2013
(Continued)

OTHER PUBLICATIONS

International Search Report.
European Search Report Dated Jan. 28, 2016.

*Primary Examiner* — Hien Vu
(74) *Attorney, Agent, or Firm* — Gerald E. Hespos; Michael J. Porco; Matthew T. Hespos

(57) ABSTRACT

A device connector (1) is provided in a device unit that has plural devices arranged in parallel and is to be connected to a wire-side connector (30). The device connector (1) has terminal accommodating portions (12) provided respectively for the devices and arranged in parallel along a direction (A) in which the devices are arranged. A holding portion (22) collectively holds the terminal accommodating portions (12). Positioning plates (18) are provided individually on the terminal accommodating portions (12), and positioning recesses (25) are at positions of the holding portion (22) corresponding respectively to the positioning plates (18) with the terminal accommodating portions (12)
(Continued)

collectively held and configured to position the terminal accommodating portions (12) and the holding portion (22) by engaging the positioning plates (18).

5 Claims, 10 Drawing Sheets

(58) Field of Classification Search
USPC ..... 439/211, 210, 215, 627
See application file for complete search history.

(56) References Cited

U.S. PATENT DOCUMENTS

| | | | | |
|---|---|---|---|---|
| 6,319,071 | B1 * | 11/2001 | Sato | H01R 4/185 439/701 |
| 7,892,669 | B2 * | 2/2011 | Yang | H01M 2/0212 429/100 |
| 9,153,806 | B2 * | 10/2015 | Yoshioka | H01M 2/1077 |
| 2008/0138698 | A1 | 6/2008 | Ogami et al. | |
| 2010/0221959 | A1 | 9/2010 | Pan | |
| 2011/0014512 | A1 | 1/2011 | Amagai | |
| 2012/0202363 | A1 * | 8/2012 | McNamara | H01R 13/6461 439/74 |
| 2013/0029201 | A1 | 1/2013 | Motohashi et al. | |

FOREIGN PATENT DOCUMENTS

| | | | |
|---|---|---|---|
| EP | 2262040 | A1 | 12/2010 |
| JP | 2006-344419 | | 12/2006 |
| JP | 2008-147045 | | 6/2008 |
| JP | 2012-134016 | | 7/2012 |
| WO | 2011/125812 | | 10/2011 |

* cited by examiner

DEVICE CONNECTOR

BACKGROUND

1. Field of the Invention

The present invention relates to a device connector.

2. Description of the Related Art

Conventionally, a device connector with a plurality of device-side receptacles for accommodating a plurality of male terminals inside is known, for example, from Japanese Unexamined Patent Publication No. 2006-344419. On the other hand, a wire-side connector connectable to this device connector is provided with female terminals to be connected to the male terminals and a plurality of terminal holding tube portions including cavities for accommodating the female terminals inside and to be inserted into the device-side receptacles. Thus, when the wire-side connector is connected to the device connector, the terminal holding tube portions are inserted into the device-side receptacles and the male terminals are connected to the female terminals.

However, in the device connector configured as described above, the plurality of device-side receptacles may be relatively displaced from each other due to a mounting tolerance and the like of the plurality of device-side receptacles. In such a case, the terminal holding tube portions of the wire-side connector interfere with the device-side receptacles and it may become impossible to connect the device connector to the wire-side connector.

The present invention was completed based on the above situation and aims to provide a device connector capable of being smoothly connected to a mating connector.

SUMMARY

The present invention is directed to a device connector provided in a device unit in which a plurality of devices are arranged in parallel and to be connected to a mating connector, including a plurality of terminal accommodating portions individually provided for the plurality of devices and arranged in parallel along a parallel direction in which the plurality of devices are arranged in parallel, a holding portion configured to collectively hold the plurality of terminal accommodating portions, a plurality of positioning portions individually provided on the plurality of terminal accommodating portions, and a plurality of positioned portions provided at positions of the holding portion respectively corresponding to the plurality of positioning portions with the plurality of terminal accommodating portions collectively held and configured to relatively position the plurality of terminal accommodating portions and the holding portion by being engaged with the plurality of positioning portions.

According to such a configuration, it is avoided that the plurality of terminal accommodating portions interfere with the mating connector due to relative displacements of the terminal accommodating portions, and the device connector and the mating connector are smoothly connected.

The following modes are preferable as embodiments of the present invention. The plurality of positioning portions preferably project toward the holding portion, and the plurality of positioned portions are preferably recessed at positions of the holding portion aligned with the plurality of positioning portions and configured such that the plurality of positioning portions are fitted thereinto with the plurality of terminal accommodating portions collectively held.

According to the above mode, the positioning portions projecting toward the holding portion are fitted into and engaged with the positioned portions, whereby the plurality of terminal accommodating portions and the holding portion can be reliably relatively positioned.

Preferably, the plurality of positioning portions are in the form of plates extending in an intersection direction intersecting with the parallel direction, and the plurality of positioned portions are in the form of slits extending in the intersection direction and configured such that the positioning portions are fitted thereinto.

Here, since the plurality of terminal accommodating portions are individually provided for each device and arranged in parallel along the parallel direction of the plurality of devices, intervals between adjacent terminal accommodating portions particularly tend to vary. Thus, the terminal accommodating portions are formed into the plates extending in the intersection direction intersecting with the parallel direction of the terminal accommodating portions and the positioned portions are formed into the slits extending in the intersection direction and configured such that the positioning portions are fitted thereinto. According to such a configuration, the positioning portions are fitted into the positioned portions and the outer surfaces of the positioning portions and the inner surfaces of the positioned portions slide in contact, whereby the plurality of terminal accommodating portions can be reliably positioned in the parallel direction of the terminal accommodating portions and the device connector and the mating connector can be smoothly connected.

According to the present invention, it is possible to provide a device connector capable of being smoothly connected to a mating connector.

DETAILED DESCRIPTION

An embodiment of the present invention is described in detail with reference to FIGS. 1 to 10. A device connector 1 in this embodiment is provided in a device unit in which a plurality of flat devices such as batteries and substrates are arranged in parallel, and connected to a wire-side connector 30 (corresponding to a mating connector) (see FIGS. 1 and 2).

A battery module is cited as an example of the device unit. The battery module is integrated by stacking (in parallel) a plurality of single cells (not shown) formed into a flat shape in a thickness direction (parallel direction A) and fixing and holding the front ends of the single cells by a holding member 2, and the device connector 1 is provided on this holding member 2. Note that, in the following description, a connection surface side of each connector 1, 30 with a mating side is referred to as a front side.

Figure 3:
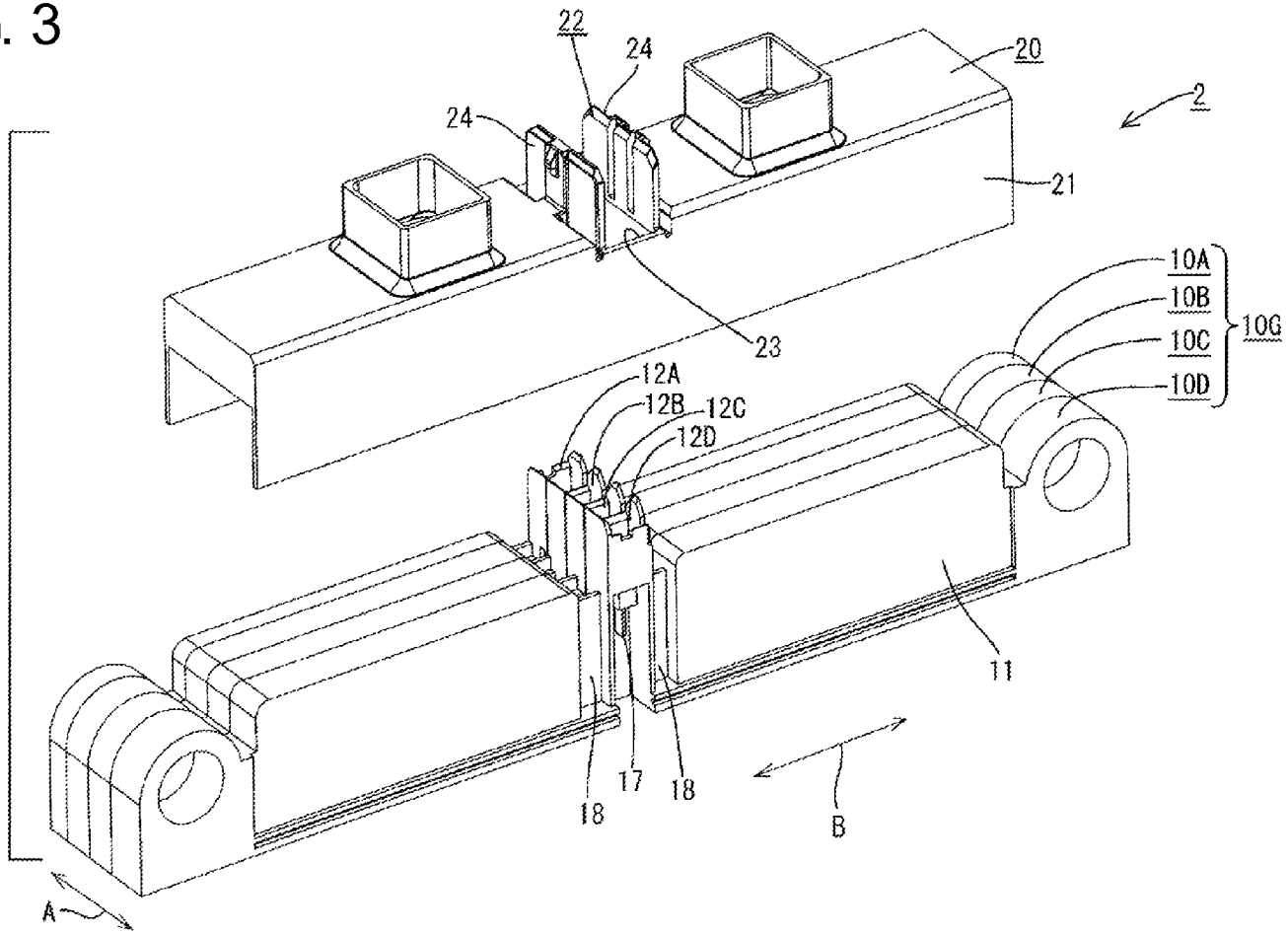
FIG. 3 is an exploded perspective view of the holding member in the embodiment.

The holding member 2 is composed of a plurality of (four in this embodiment) receptacles 10A, 10B, 10C and 10D independently provided for each single cell and a receptacle case 20 for fixing and holding these plurality of receptacles 10A, 10B, 10C and 10D (see FIG. 3). Note that since the four receptacles 10A, 10B, 100 and 10D are basically identically configured, they are described taking the receptacle 10A as a representative and merely referred to as "receptacles 10" to avoid repeated description below.

Figure 4:
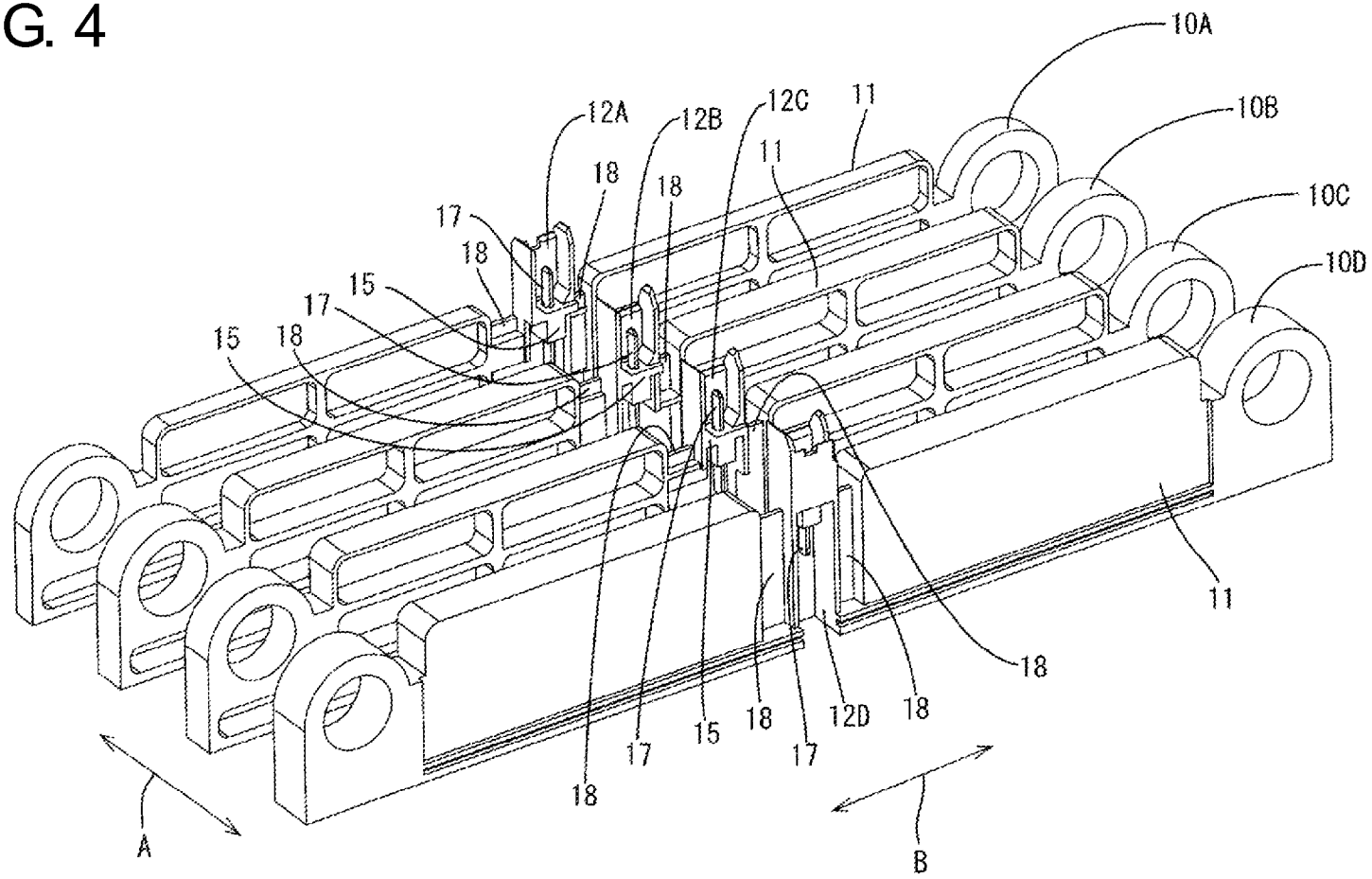
FIG. 4 is a perspective view of receptacles in the embodiment.
Figure 5:
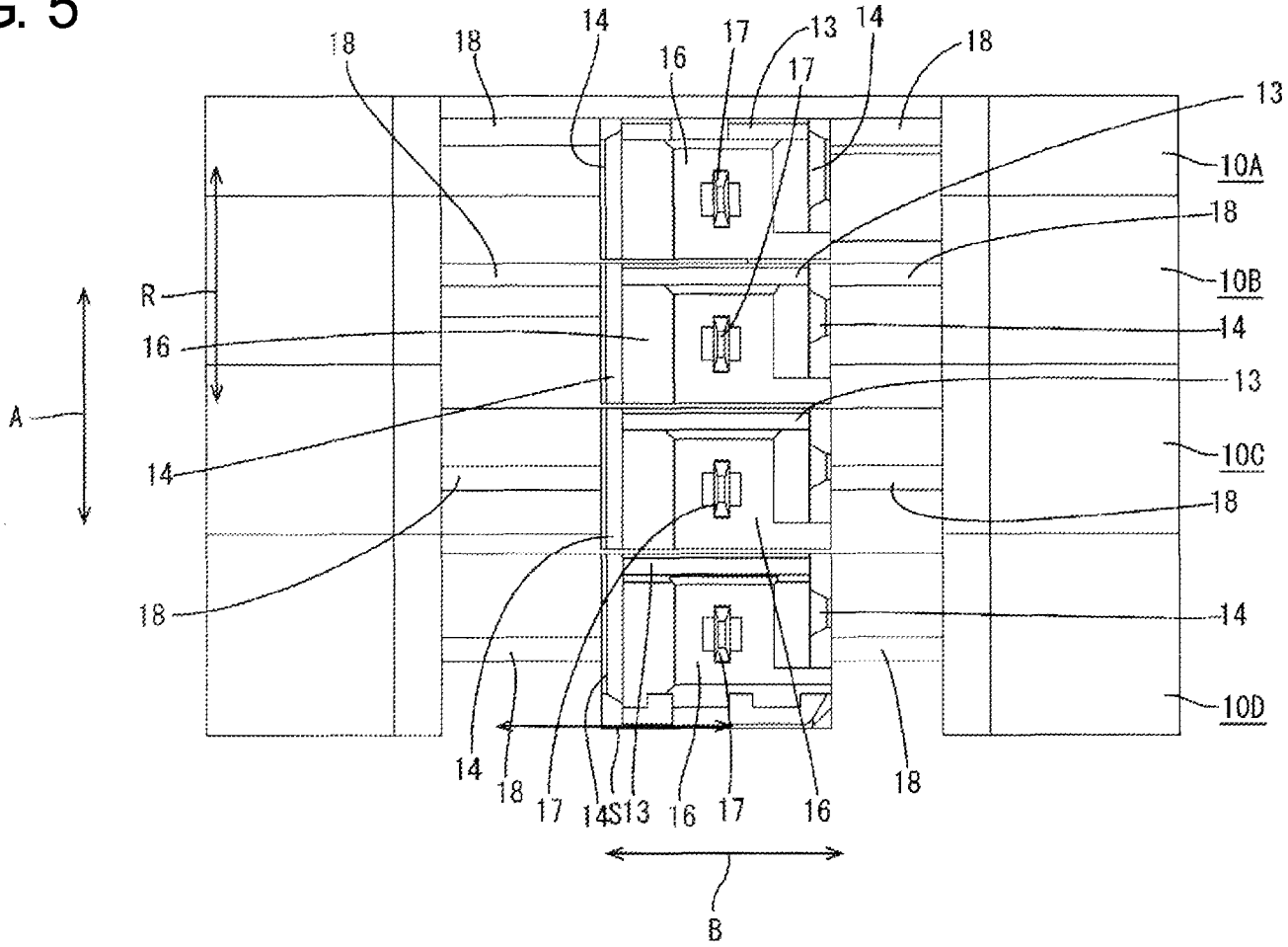
FIG. 5 is a partial enlarged front view of the receptacles of the embodiment.

The receptacle 10 includes a block-like receptacle main body 11 formed flat as a whole (see FIGS. 4 and 5). This receptacle main body 11 is mounted to cover the front end surface of each single cell. In a state where the plurality of single cells are arranged in parallel in the parallel direction A, the receptacles 10 provided for each single cell are also arranged in parallel in the parallel direction A to constitute a receptacle group 10G.

In the receptacle main body 11, a terminal accommodating portion 12 is provided at a longitudinal center position. For the receptacle 10D arranged on one end in the parallel direction A out of the four receptacles 10A, 10B, 10C and 10D, the terminal accommodating portion 12D is formed into a rectangular tube including a pair of first side walls 13 standing along an intersection direction B intersecting with the parallel direction A of the plurality of receptacles 10 and a pair of second side walls 14 standing along the parallel direction A of the plurality of receptacles 10 and coupling side edges of the pair of first side walls 13 when viewed from front. On the other hand, for the other three receptacles 10A, 10B and 100, the terminal accommodating portion 12A, 12B, 12C includes a first side wall 13 provided on one of a pair of facing surfaces facing the adjacent receptacles 10 when viewed from front and a pair of second side walls 14 standing along the parallel direction A of the plurality of receptacles 10, and the other surface out of the pair of facing surfaces is fully open.

Note that, in this embodiment, the intersection direction B is perpendicular to the parallel direction A. Here, perpendicular means a case where an angle between the parallel direction A and the intersection direction B is 90° and also a case where this angle is recognized to be substantially 90° even if it is not 90°.

These terminal accommodating portions 12 penetrate through the receptacle main bodies 11 in a front-back direction, and the front ends thereof project further forward than the front surfaces of the receptacle main bodies 11. A partition wall 15 partitioning an inner space of the terminal accommodating portion 12 into front and rear spaces is provided in each terminal accommodating portion 12.

In a state where the four receptacles 10 are stacked in parallel, opening surfaces of the terminal accommodating portions 12 in the three receptacles 10A, 10B and 10C are closed by the first side walls 13 of the adjacent receptacles 10B, 10C and 10D, whereby cavities 16 in the form of rectangular tubes having a rectangular cross-section are formed. A male terminal 17 is arranged through the partition wall 15 in the cavity 16. This male terminal 17 is connected to an electrode tab or a voltage detection tab of each single cell.

A positioning plate 18 (example of a positioning portion) is provided on each of outer side surfaces of the pair of second side walls 14 in the terminal accommodating portion 12. The positioning plate 18 is formed to project forward (direction toward a holding portion 22 to be described later) from the outer side surface of the second side wall 14.

Further, the positioning plate 18 is in the form of a plate extending in the intersection direction B intersecting with the parallel direction A of the plurality of receptacles 10. In other words, the positioning plate 18 is formed to extend in parallel to a longitudinal direction of the receptacle 10.

Figure 6:
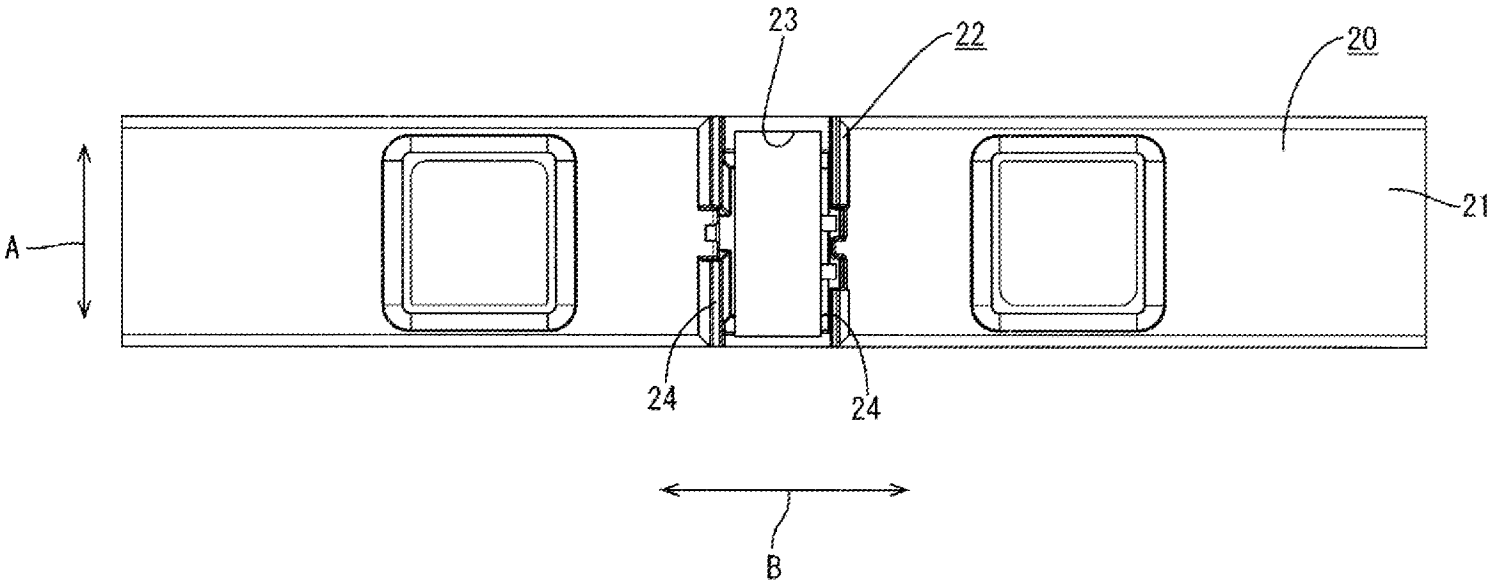
FIG. 6 is a front view of a receptacle case in the embodiment.
Figure 7:
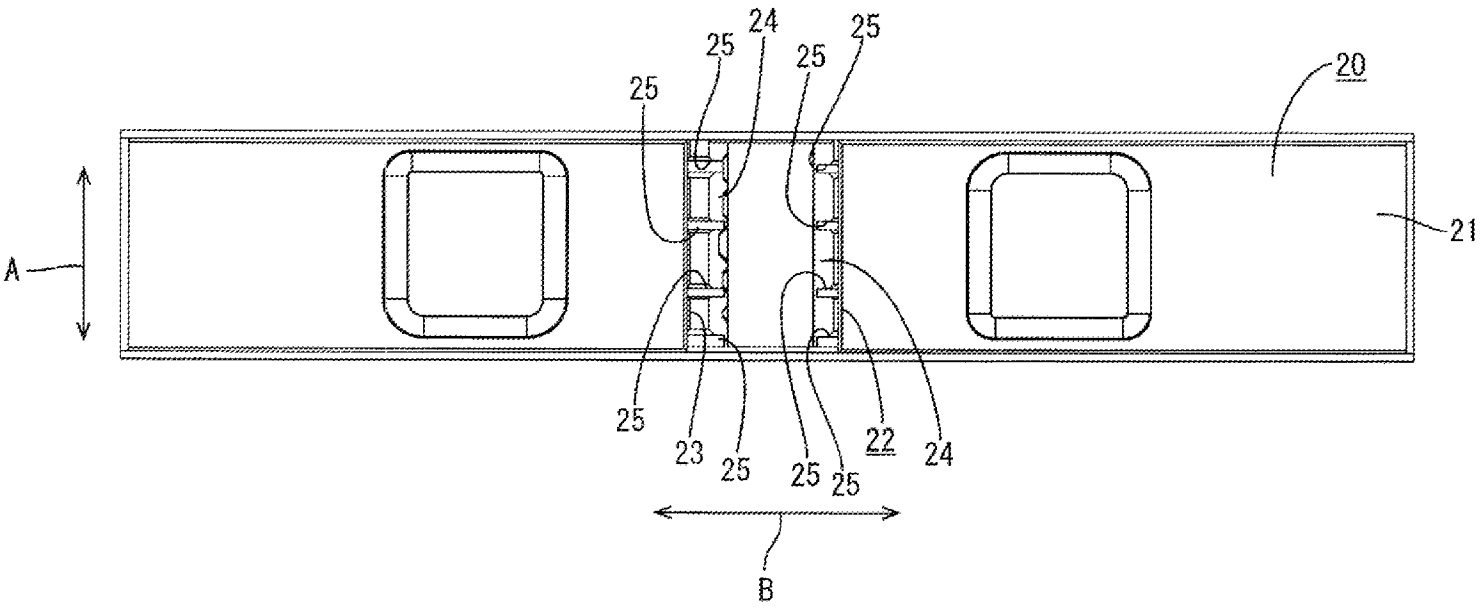
FIG. 7 is a rear view of the receptacle case in the embodiment.
Figure 8:
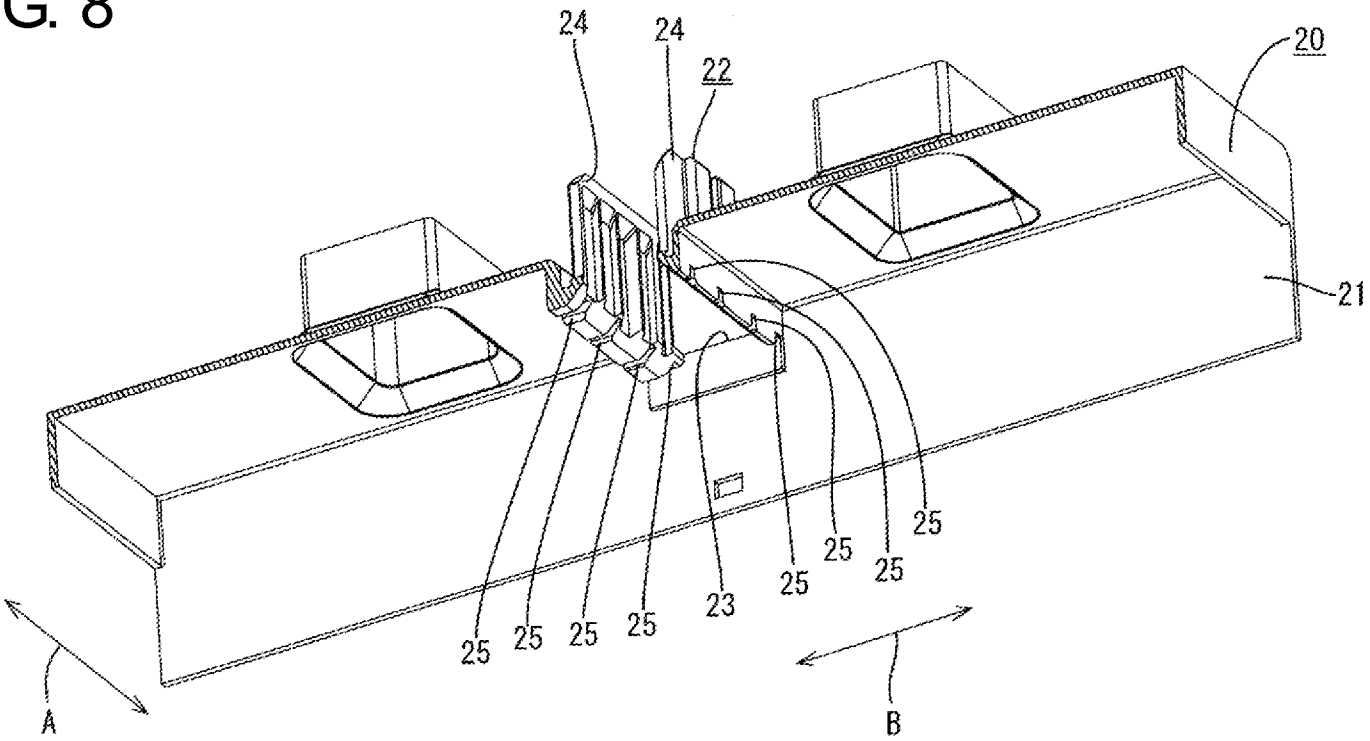
FIG. 8 is a perspective view of the receptacle case in the embodiment when viewed from behind.

The receptacle case 20 for fixing and holding these plurality of receptacles 10 is formed flat as a whole and includes a case main body 21 formed into a substantially rectangular tube with an open rear surface side (see FIGS. 6 to 8). The receptacle main bodies 11 of the respective receptacles 10 constituting the receptacle group 10G are collectively accommodated in this case main body 21.

The holding portion 22 for holding the terminal accommodating portions 12 of the receptacles 10 inside is provided on the front wall of the case main body 21. The holding portion 22 includes a pair of receiving wall portions 24 extending from the opening edge of an opening 23 open on the front wall of the case main body 21. The opening 23 is formed to have a rectangular shape at a position aligned with the terminal accommodating portions 12 in a state where the receptacle main bodies 11 are accommodated in the case main body 21.

The pair of receiving wall portions 24 respectively extend backward (toward the receptacles 10) from a pair of sides extending in a direction intersecting with a longitudinal direction of the case main body 21 (pair of sides extending in a direction along the parallel direction A) on the opening edge of the opening 23 and are folded at extending ends thereof to extend forward. The front ends of the receiving wall portions 24 are located substantially at the same positions as the front ends of the terminal accommodating portions 12 with the receptacle main bodies 11 accommodated in the receptacle case 20. With the receptacle main bodies 11 accommodated in the receptacle case 20, the terminal accommodating portions 12 are inserted into the opening 23 of the receptacle case 20 from behind and held in a state sandwiched between the pair of receiving wall portions 24. The device connector 1 connectable to the mating wire-side connector 30 is formed by these receiving wall portions 24 and terminal accommodating portions 12.

Figure 9:
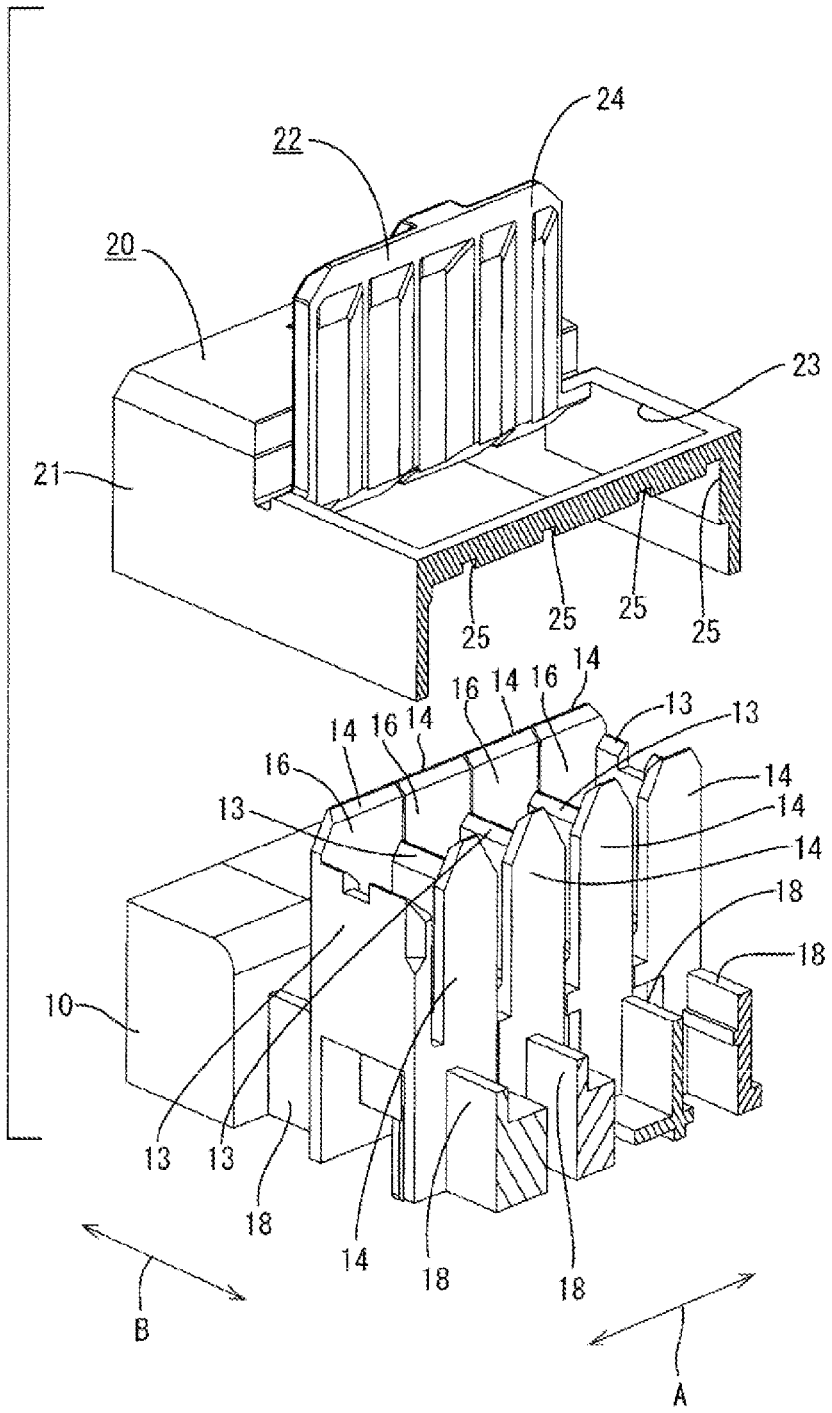
FIG. 9 is a partial enlarged view showing a state before the receptacle case is assembled with the receptacles of the embodiment.
Figure 10:
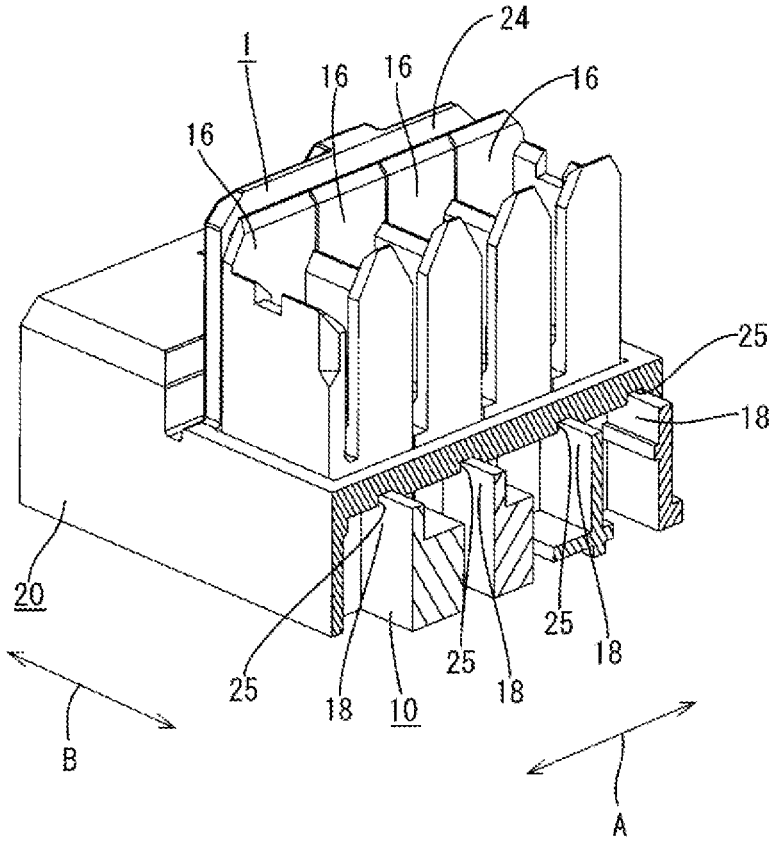
FIG. 10 is a partial enlarged view showing a state where the receptacle case is assembled with the receptacles of the embodiment.

A plurality of positioning recesses 25 (example of positioned portions) to be engaged with the positioning plates 18 are provided by recessing the rear ends of the receiving wall portions 24 (see FIGS. 9 and 10). Each positioning recess 25 is arranged at a position aligned with the corresponding positioning plate 18 with the receptacle main bodies 11 accommodated in the receptacle case 20 and formed into a slit extending in the front-back direction on a rear end part of the receiving wall portion 24. The positioning recess 25 is formed to extend in a direction along the intersection direction B. With the receptacle main bodies 11 accommodated in the receptacle case 20, the positioning plates 18 are inserted into and engaged with the positioning recesses 25. The outer surfaces of the positioning plate 18 slide in contact with the inner surfaces of the positioning recesses 25, whereby the plurality of terminal accommodating portions 12 are positioned in a direction along the parallel direction A.

Figure 1:
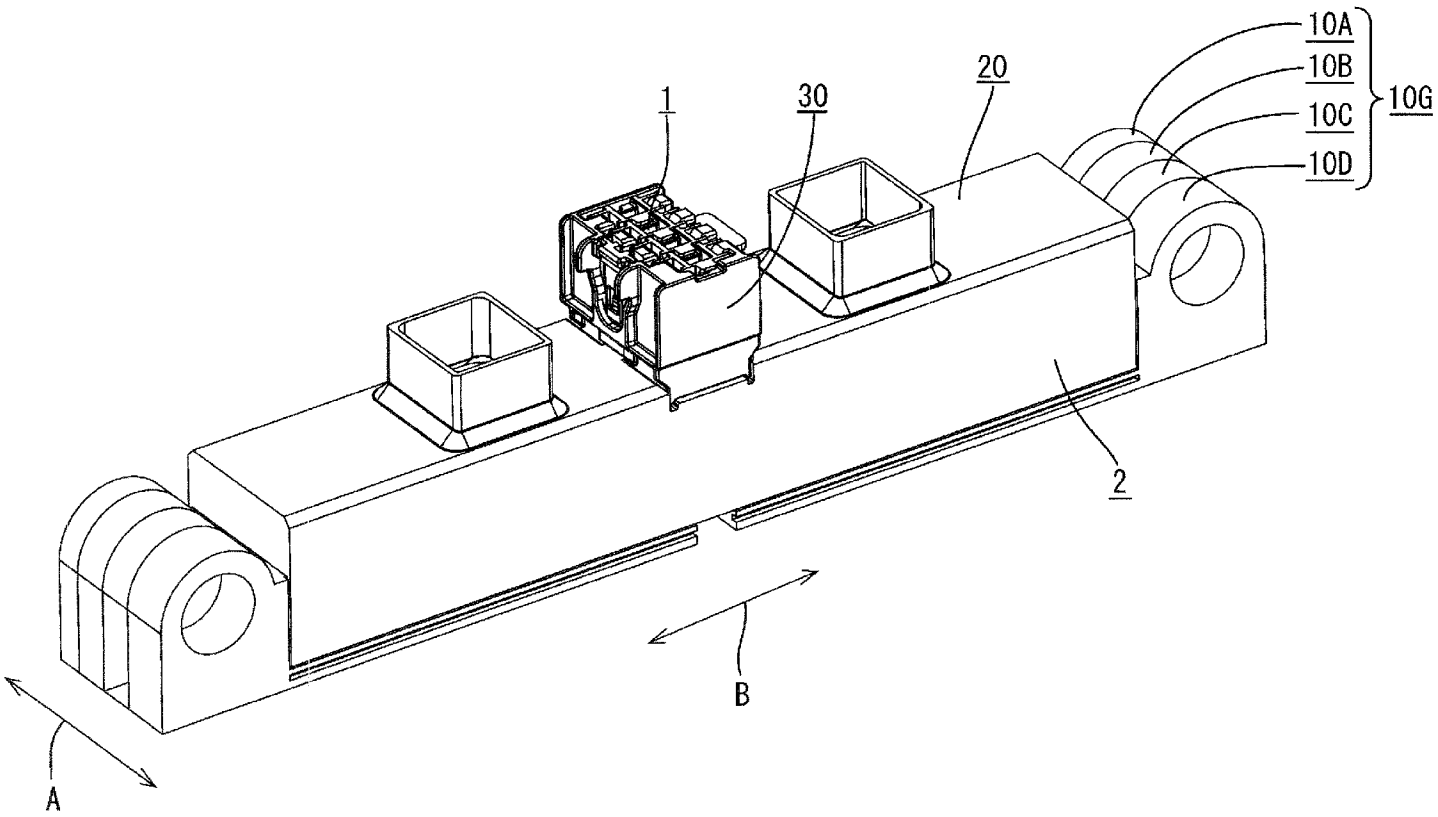
FIG. 1 is a perspective view showing a state where a wire-side connector is connected to a device connector of a holding member in an embodiment.
Figure 2:
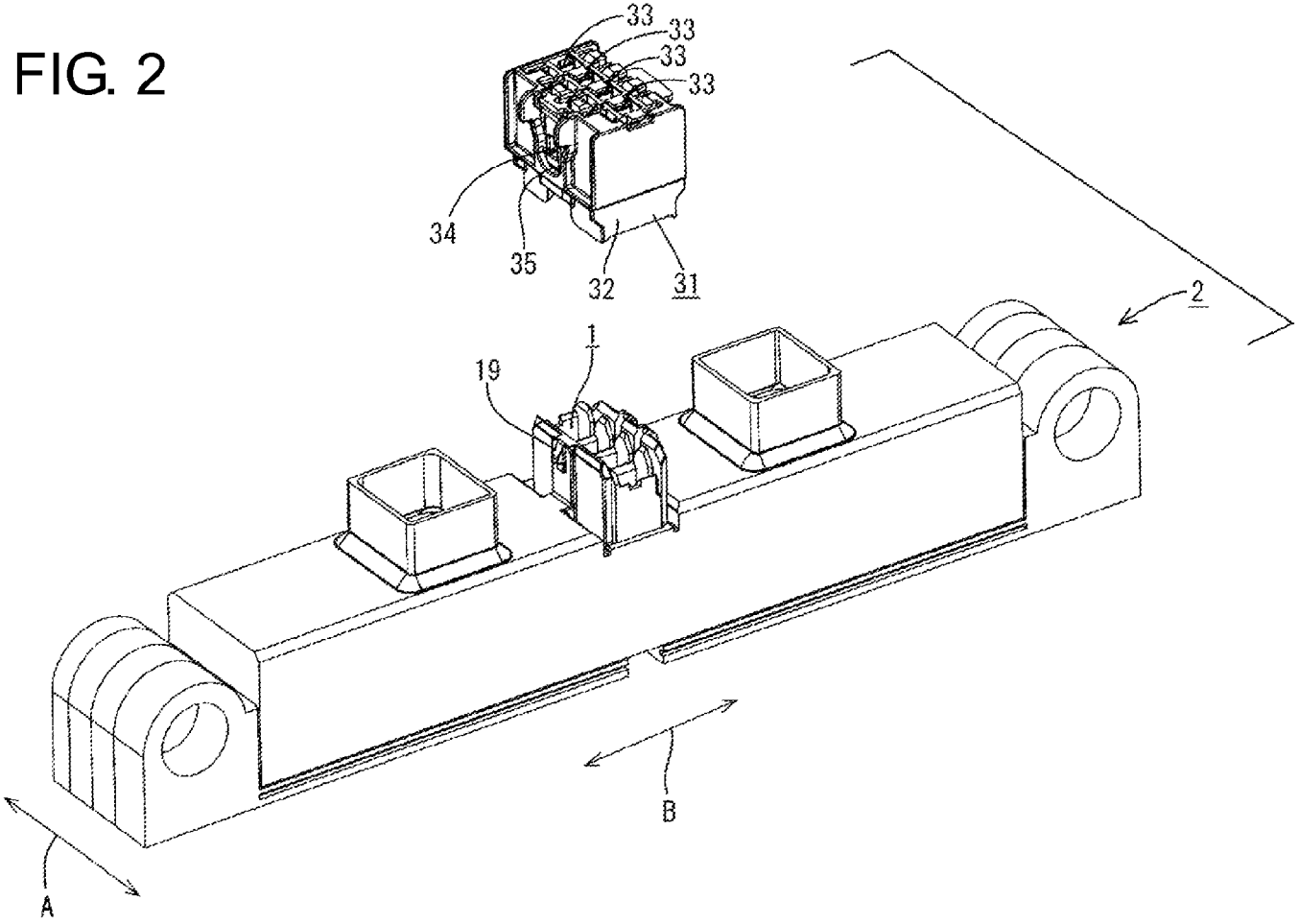
FIG. 2 is a perspective view showing a state before the wire-side connector is connected to the device connector of the holding member in the embodiment.

On the other hand, the wire-side connector 30 to be connected to the device connector 1 is a connector connected to ends of wires (not shown) such as a voltage detection line and a power line (see FIGS. 1 and 2). This wire-side connector 30 includes a connector frame 31 and terminal accommodating cases 33 mounted in this connector frame 31.

The connector frame 31 includes a frame main body 32 formed into a frame open in the front-back direction and fittable to the device connector 1. Four terminal accommodating cases 33 individually fittable to the four cavities 16 of the device connector 1 are accommodated in this frame main body 32.

Each terminal accommodating case 33 is formed into a rectangular tube penetrating in the front-back direction and insertable into the cavity 16 in the device connector 1. A female terminal is accommodated in this terminal accommodating case 33. Although not shown in detail, the female terminal has such a general configuration that one end part is connected to the wire and the other end part is connectable to the mating male terminal 17.

The terminal accommodating case 33 is inserted into the connector frame 31 through a rear surface side and accommodated in the connector frame 31 to project forward from the rear end. The four terminal accommodating cases 33 are arranged in parallel in a direction along the parallel direction of the receptacles 10 (parallel direction of the terminal accommodating portions 12) in the holding member 2 and arranged at the same intervals as the respective cavities 16 with the connector frame 31 fitted to the device connector 1.

Lock arms 34 in the form of flat plates are provided on side surfaces of the connector frame 31. This lock arm 34 extends forward in a cantilever manner after standing up from the rear end of the connector frame 31 and is resiliently deformable with a rear end part as a supporting point. A lock hole 35 is formed to penetrate through a front end part of this lock arm 34 in a plate thickness direction.

On the other hand, lock protrusions 19 engageable with the lock holes 35 are provided at positions aligned with the lock holes 35 of the lock arms 34 on the receiving wall portions 24 of the case main body 21 constituting the device connector 1.

When the device connector 1 of the holding member 2 configured as described is connected to the wire-side connector 30, each terminal accommodating case 33 of the wire-side connector 30 is inserted into the corresponding cavity 16 in the device connector 1.

Here, the receptacles 10 are designed to be stacked at fixed intervals in the holding member 2, but intervals between adjacent terminal accommodating portions 12 may vary due to a dimensional tolerance and the like. Thus, in this embodiment, the plurality of terminal accommodating portions 12 are positioned in the parallel direction A of the receptacles 10 and arranged at positions corresponding to the terminal accommodating cases 33 of the wire-side connector 30 by engaging the positioning plates 18 provided on the respective receptacles 10 with the positioning recesses 25 provided on the receptacle case 20. In this way, it is avoided that the terminal accommodating portions 12 interfere with the mating terminal accommodating cases 33 due to displacements of the terminal accommodating portions 12, thereby making it impossible to fit the terminal accommodating portions 12 and the terminal accommodating cases 33 to each other, and the device connector 1 and the wire-side connector 30 are smoothly connected.

When the device connector 1 and the wire-side connector 30 reach a properly connected state, the male terminals 17 are electrically conductively connected to the female terminals. Further, the lock protrusions 19 are fitted into and locked to the lock holes 35 of the lock arms 34, whereby the device connector 1 and the wire-side connector 30 are locked in a connected state.

As described above, according to this embodiment, the device connector 1 is provided in the device unit in which the plurality of devices are arranged in parallel, and connected to the wire-side connector 30 connected to the ends of the wires. The device connector 1 is individually provided for the plurality of devices and includes the plurality of terminal accommodating portions 12 arranged in parallel along the parallel direction A in which the plurality of devices are arranged in parallel, the holding portion 22 configured to collectively hold the plurality of terminal accommodating portions 12, the plurality of positioning plates 18 individually provided on the plurality of terminal accommodating portions 12 and the plurality of positioning recesses 25 provided at the positions of the holding portion 22 respectively corresponding to the plurality of positioning plates 18 with the plurality of terminal accommodating portions 12 collectively held and configured to relatively position the plurality of terminal accommodating portions 12 and the holding portion 22 by being engaged with the plurality of positioning plates 18.

According to such a configuration, it is avoided that the plurality of terminal accommodating portions 12 interfere with the terminal accommodating cases 33 of the wire-side connector 30 due to relative displacements of the terminal accommodating portions 12, and the device connector 1 and the wire-side connector 30 are smoothly connected.

Further, according to this embodiment, the plurality of positioning plates 18 are formed to project toward the holding portion 22, the positioning recesses 25 are formed at the positions of the holding portion 22 aligned with the positioning plates 18 and the positioning plates 18 are fitted into the positioning recesses 25 with the plurality of terminal accommodating portions 12 collectively held. The positioning plates 8 projecting toward the holding portion 22 and the positioning recesses 25 formed at the positions aligned with these positioning plates 18 and configured such that the positioning plates 18 are fitted thereinto are engaged, whereby the plurality of terminal accommodating portions 12 and the holding portion 22 can be reliably relatively positioned.

According to this embodiment, the plurality of positioning plates 18 are in the form of plates extending along the intersection direction B intersecting with the parallel direction A, and the plurality of positioning recesses 25 are in the form of slits extending along the intersection direction B and configured such that the plurality of positioning plates 18 are fitted thereinto.

Here, since the plurality of terminal accommodating portions 12 are individually provided for each device and arranged in parallel along the parallel direction of the plurality of devices, intervals between adjacent terminal accommodating portions 12 particularly tend to vary. Thus, the terminal accommodating portions 12 are positioned by the positioning plates 18 in the form of plates extending in the intersection direction intersecting with the parallel direction of the terminal accommodating portions 12 and the positioning recesses 25 in the form of slits configured such that these positioning plates 18 are fitted thereinto. According to such a configuration, the positioning plates 18 are fitted into the positioning recesses 25 and the outer surfaces of the positioning plates 18 and the inner surfaces of the positioning recesses 25 slide in contact, whereby the plurality of terminal accommodating portions 12 can be reliably positioned in the parallel direction A of the terminal accommodating portions 12 and the device connector 1 and the wire-side connector 30 can be smoothly connected.

The present invention is not limited to the above described and illustrated embodiment. For example, the following embodiments are also included in the technical scope of the present invention.

Although the terminal accommodating portions 12 are provided with the positioning plates 18 and the holding portion 22 is provided with the positioning recesses 25 in the above embodiment, there is no limitation to this and the holding portion may be provided with the positioning plates and the terminal accommodating portions may be provided with the positioning recesses.

Although the positioning portions are the positioning plates 18 and the positioning recesses 25 in the above embodiment, the shapes of the positioning portions are not particularly limited and the positioning portions have only to be designed for positioning by being engaged with each other.

Although the four terminal accommodating portions 12 are arranged in parallel along the parallel direction A in the above embodiment, there is no limitation to this and two, three, five or more terminal accommodating portions 12 may be arranged in parallel.

Although the parallel direction A and the intersection direction B are perpendicular in the above embodiment, there is no limitation to this and the parallel direction A and the intersection direction B may intersect at an arbitrary angle if necessary.

Although the positioning portions are in the form of plates and the positioned portions are in the form of slits in the above embodiment, there is no limitation to this and the positioning portions can be formed into an arbitrary shape such as a cylindrical shape, a rectangular column shape, a polygonal column shape, a conical shape, a truncated conical shape or a truncated pyramidal shape if necessary. Further, the positioned portions can be formed by being recessed while having an inner surface shape corresponding to a cross-sectional shape of the positioning portions and formed such that the positioning portions are fitted thereinto.

LIST OF REFERENCE SIGNS

1: device connector
12: terminal accommodating portion
22: holding portion
18: positioning plate
25: positioning recess
A: parallel direction
B: intersection direction

The invention claimed is:

1. An electrical device connector provided in a device unit in which plural electrical devices are arranged adjacent to one another in an arrangement direction (A), each electrical device extending in an extending direction (B) and the electrical devices being aligned so that the extending directions (B) are parallel to one another and perpendicular to the arrangement direction (A), the electrical device connector being connectable to a mating electrical connector, and comprising:

device receptacles extending parallel to one another in the extending direction (B) and being adjacent to one another in the arrangement direction (A), each of the device receptacles being configured to accommodate one of the electrical devices, each of the device receptacles having a terminal accommodating portion arranged so that the terminal accommodating portions are substantially adjacent to one another, at least one positioning plate extending from each of the respective terminal accommodating portions and aligned along the extending direction (B);

a case collectively holding the device receptacles, an opening formed through the case and aligned with the terminal accommodating portions and at least one holding portion projecting from the case adjacent to the opening and configured to collectively hold the terminal accommodating portions, the at least one holding portion having a plurality of slits disposed and dimensioned to receive the respective positioning plates for positioning the terminal accommodating portions relative to the opening and relative to the at least one holding portion.

2. The electrical device connector of claim 1, wherein the case defines an elongate channel having an open side that collectively mounts over the device receptacles.

3. The electrical device connector of claim 2 wherein the at least one holding portion comprises first and second holding portions aligned substantially parallel to one another on opposite respective sides of the opening.

4. The electrical device connector of claim 3, wherein the first holding portion is formed with a first plurality of the slits, and the second holding portion is formed with a second plurality of the slits.

5. The electrical device connector of claim 4, wherein the at least one positioning plate for each of the terminal accommodating portions comprises first and second positioning plates on each of the terminal accommodating portions, the first and second positioning plates on each of the terminal accommodating portions being received respectively in one of the first plurality of slits formed on the first holding portion and in one of the second plurality of slits formed on the second holding portion.

* * * * *